US009277780B2

(12) United States Patent
Hillion

(10) Patent No.: US 9,277,780 B2
(45) Date of Patent: Mar. 8, 2016

(54) ELECTRICIAN'S HELMET FOR MECHANICAL AND ELECTRICAL PROTECTION AND PROTECTION AGAINST THERMAL HAZARDS

(75) Inventor: Nicolas Hillion, Quebec (CA)

(73) Assignee: SOCIETE ANONYME DES ETS CATU, Bagneux (FR)

( * ) Notice: Subject to any disclaimer, the term of this patent is extended or adjusted under 35 U.S.C. 154(b) by 0 days.

(21) Appl. No.: 14/397,701

(22) PCT Filed: Apr. 30, 2012

(86) PCT No.: PCT/FR2012/050967

§ 371 (c)(1),
(2), (4) Date: Oct. 29, 2014

(87) PCT Pub. No.: WO2013/164520

PCT Pub. Date: Nov. 7, 2013

(65) Prior Publication Data

US 2015/0074879 A1 Mar. 19, 2015

(51) Int. Cl.

| | |
|---|---|
| ***A42B 3/18*** | (2006.01) |
| ***A42B 3/10*** | (2006.01) |
| ***A42B 3/22*** | (2006.01) |
| *A42B 3/04* | (2006.01) |

(52) U.S. Cl.
CPC . *A42B 3/18* (2013.01); *A42B 3/105* (2013.01); *A42B 3/225* (2013.01)

(58) Field of Classification Search
CPC ..... A42B 3/22; A42B 3/222; A42B 3/223; A42B 3/225; A42B 3/00; A42B 3/04; A42B 3/105; A42B 3/226; A42B 3/326
See application file for complete search history.

(56) References Cited

U.S. PATENT DOCUMENTS

| | | | | | |
|---|---|---|---|---|---|
| 3,315,272 | A | * | 4/1967 | Olt et al. | 2/424 |
| 3,594,814 | A | * | 7/1971 | Schuessler et al. | 2/410 |
| 3,688,314 | A | * | 9/1972 | Hill | 2/457 |
| 4,100,619 | A | * | 7/1978 | Piech et al. | 2/10 |
| 4,397,045 | A | * | 8/1983 | Schonwetter et al. | 2/5 |
| 4,573,217 | A | * | 3/1986 | Reed | 2/7 |
| 4,593,417 | A | * | 6/1986 | Brown et al. | 2/172 |
| 4,885,806 | A | * | 12/1989 | Heller | 2/423 |

(Continued)

FOREIGN PATENT DOCUMENTS

WO 2006061007 A1 6/2006

OTHER PUBLICATIONS

International Search Report, dated Mar. 5, 2013, from corresponding PCT application.

*Primary Examiner* — Bobby Muromoto, Jr.
(74) *Attorney, Agent, or Firm* — Young & Thompson

(57) ABSTRACT

Disclosed is a protective helmet designed to be worn by an electrician, including: an outer shell (2); a face shield (3) integral with the helmet (1), the face shield is irremovably secured to the outer shell and is mobile relative to the outer shell, and allows a stowed position in which it is at least partially inserted into an inner space of the helmet (1) which is defined by the outer shell, and a working position in which it projects from the inner space; and a flexible flap (4) integral with the helmet, which is irremovably secured to the face shield, and mobile relative to the face shield, and which further allows a retracted configuration in which it at least partially covers a surface (16) of the face shield and a working configuration in which it is deployed and extends the face shield.

20 Claims, 4 Drawing Sheets

(56) References Cited

U.S. PATENT DOCUMENTS

| | | | | | |
|---|---|---|---|---|---|
| 4,961,232 | A * | 10/1990 | Hulsey | 2/206 |
| 5,062,163 | A * | 11/1991 | Avey | 2/424 |
| 5,212,837 | A * | 5/1993 | Gose et al. | 2/172 |
| 5,544,361 | A * | 8/1996 | Fine et al. | 2/10 |
| 5,549,104 | A * | 8/1996 | Crump et al. | 128/201.25 |
| 5,628,308 | A * | 5/1997 | Harges et al. | 128/206.21 |
| 5,823,188 | A * | 10/1998 | Harges et al. | 128/206.19 |
| 5,875,493 | A * | 3/1999 | MacDonald et al. | 2/172 |
| 5,926,854 | A * | 7/1999 | Grilliot et al. | 2/424 |
| 6,289,521 | B1 * | 9/2001 | Ikeda | 2/421 |
| 6,438,763 | B2 * | 8/2002 | Guay et al. | 2/424 |
| 2002/0069873 | A1 * | 6/2002 | Hetzel, Jr. | 128/201.29 |
| 2006/0174396 | A1 * | 8/2006 | Rosas | 2/175.6 |
| 2007/0261153 | A1 * | 11/2007 | Wise et al. | 2/423 |
| 2010/0064405 | A1 | 3/2010 | McGovern | |
| 2010/0107318 | A1 * | 5/2010 | Asta | 2/424 |
| 2010/0192290 | A1 * | 8/2010 | Husain | 2/468 |
| 2010/0229288 | A1 * | 9/2010 | Higgins | 2/422 |
| 2011/0072548 | A1 * | 3/2011 | Hersick et al. | 2/5 |
| 2011/0302701 | A1 * | 12/2011 | Kuo | 2/421 |
| 2012/0246807 | A1 * | 10/2012 | Klotz et al. | 2/422 |
| 2012/0278963 | A1 * | 11/2012 | Hersick et al. | 2/5 |
| 2013/0219599 | A1 * | 8/2013 | Garcia | 2/424 |
| 2014/0111864 | A1 * | 4/2014 | Margulis et al. | 359/630 |
| 2014/0317834 | A1 * | 10/2014 | Power | 2/411 |
| 2014/0345037 | A1 * | 11/2014 | McKinney | 2/424 |
| 2014/0366253 | A1 * | 12/2014 | Gotti | 2/424 |
| 2015/0033430 | A1 * | 2/2015 | Hofer Kraner et al. | 2/8.2 |

* cited by examiner

ELECTRICIAN'S HELMET FOR MECHANICAL AND ELECTRICAL PROTECTION AND PROTECTION AGAINST THERMAL HAZARDS

The invention concerns the general field of the protection of electricians and in particular protective helmets provided to be worn by them.

Such protective helmets are already known that are produced from plastics material and provided with an outside shell, an inside shell and a face screen integrated with the helmet.

The face screen cannot be removed and is movable relative to the outside and inside shells. This face screen has a withdrawn position in which the screen is partially inserted into an internal space of the helmet, which space is defined between the outside shell and the inside shell; as well as a working position in which the screen projects from that internal space.

When an electrician wearing this helmet operates in the neighborhood of electrical apparatuses connected to an electrical supply or in the vicinity of bare conductive parts belonging to those apparatuses and connected to an electrical supply, for example electrical cables or busbars, the outside and inside shells are configured to mechanically and electrically protect the head of the wearer of the helmet as well as the part of the neck disposed between the bottom of the head and the top of the back (in other words the back of the neck), whereas the face screen is configured to protect the wearer's face against possible flames and/or projections of molten metal when that screen is in its extended configuration.

Such protective helmets are very appreciated since they make it possible to meet wearer protection criteria that are specific, or even in accordance with a standard, in particular with regard to mechanical and electrical protection, in a manner that is simple.

The invention is directed to providing a protective helmet of the same kind but with improved protection performance, while being particularly simple, convenient and economic both with regard to its use and its manufacture.

According to a first aspect, the invention thus relates to a protective helmet provided to be worn by an electrician, comprising an outside shell, a face screen integrated with said helmet, which face screen is connected to said outside shell so as to be non-removable and is movable relative to said outside shell, which face screen furthermore has a withdrawn position in which said face screen is inserted at least partially inside an internal space of said helmet, which internal space is delimited by said outside shell, and a working position in which said face screen projects from said internal space; characterized in that it further comprises a flexible bib integrated with said helmet, which flexible bib is connected to said face screen so as to be non-removable and is movable relative to said face screen, which flexible bib further has a retracted configuration in which said flexible bib at least partially covers a face of said face screen as well as a working configuration in which said flexible bib is extended and extends said face screen.

The protective helmet according to the invention provides particularly good performance since in addition to protecting the helmet wearer at the location of his head and neck thanks to the outside shell, as well as at the location of his face (in other words the front of his head, from the forehead to the chin), thanks to the face screen, this helmet, thanks to the flexible bib, protects the part of the wearer's body going from under the chin at least to the top of the bust, that part of the body including at least partially the sides of the neck.

Thanks to the helmet according to the invention, that performance is particularly convenient and economical to obtain since here this is a bib which is flexible, thus easily manipulable by the wearer to position it correctly in its extended configuration, and which is furthermore connected non-removably directly to the face screen (itself being connected non-removably to the outside shell), which flexible bib thus forms an extension to that face screen, while being distinct therefrom (since the bib is flexible whereas that screen is rigid, or even semi-rigid).

Furthermore, the helmet according to the invention is particularly safe and easy to use since it forms a single piece provided with three non-removable components for mechanical, electrical and thermal protection, i.e. the outside shell, the face screen and the flexible bib (these components are thus integrated with the helmet); which face screen and which flexible bib are however movable to adopt different positions and configurations, respectively of the screen and of the bib, for the protection of the front of the wearer's body (from the forehead to the top of the bust).

The outside shell, the face screen and the flexible bib are furthermore configured such that the passage from one to the other of the positions of the face screen and from one to the other of the configurations of the flexible bib is particularly simple and convenient for the wearer.

According to preferred, simple, convenient and economical features of the protective helmet according to the invention:

- said flexible bib is produced from a textile material configured to resist fire;
- said flexible bib is configured to conform to said face of said face screen that said flexible bib covers in its retracted configuration;
- said face screen has an inside free edge and an outside free edge which is an opposite edge to said inside free edge, which inside free edge is in the neighborhood of said outside shell both in the withdrawn and working positions of said face screen, whereas said outside free edge is in the neighborhood of said outside shell in said withdrawn position of said face screen and is away from said outside shell in said working position of said face screen, and said flexible bib is fastened on said outside free edge of said face screen;
- said flexible bib is fastened along a major part of said outside free edge of said face screen by rivets;
- said face screen has at least one coating layer configured to resist infrared radiation;
- said face screen furthermore has a first lateral end and a second lateral end which is an opposite end to said first lateral end, and is hinged relative to said outside shell at the location of each of said first and second lateral ends;
- it further comprises an inside shell disposed in said internal space and fastened to said outside shell, which outside and inside shells define between them an inter-shell space in which said face screen and said flexible bib are at least partly inserted when these latter are respectively in withdrawn position and retracted configuration;
- said outside shell and said inside shell are each produced from plastics material molded in a single piece and said inside shell is mechanically connected to said outside shell; and/or
- it further comprises a retaining strap in two parts, each of said two parts being connected to said outside shell.

The disclosure of the invention will now be continued with the description of an example embodiment, given below by way of illustrative and non-limiting example, with reference to the accompanying drawings, in which:

FIGS. 1 and 2 illustrate an electrician's protective helmet 1, respectively in what is referred to as a working state and in what is referred to as a resting state.

In the resting state (FIG. 2), the wearer of the helmet 1, in other words the electrician, is protected essentially only mechanically and electrically whereas in the working state (FIG. 1), the wearer is furthermore protected here against thermal hazards, as explained below.

Figure 1:
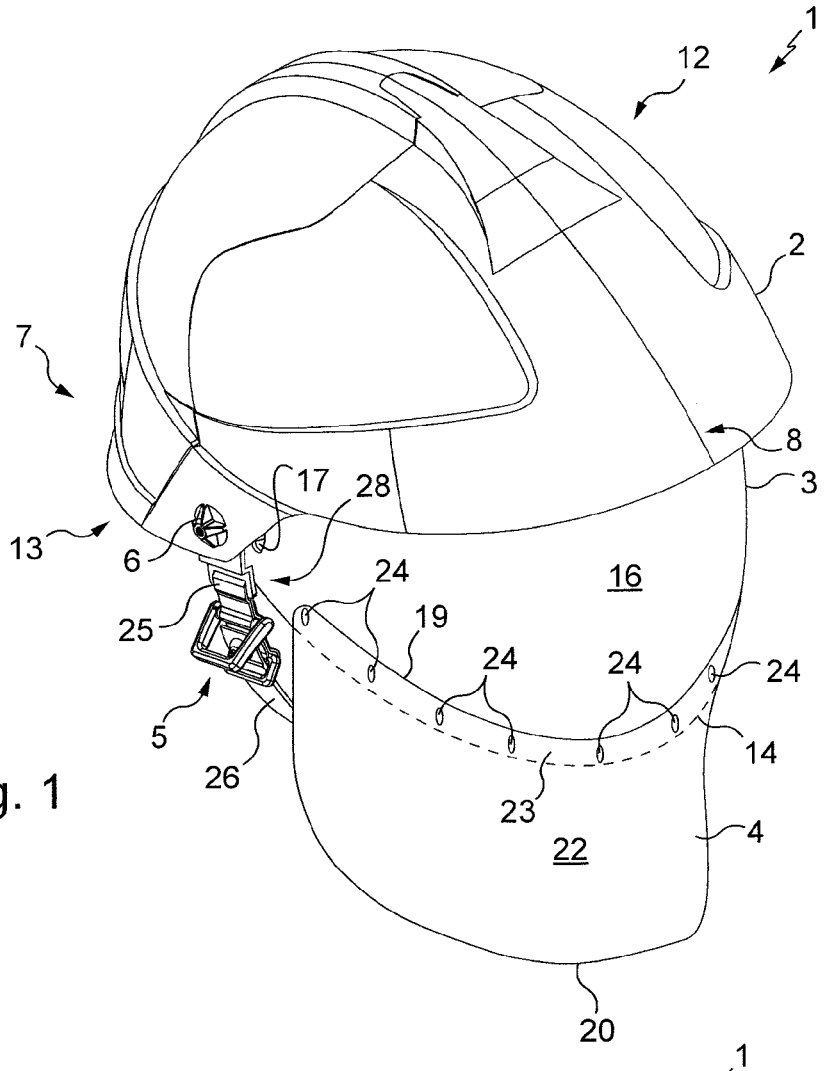
FIG. 1 is a diagrammatic perspective representation of a protective helmet in accordance with the invention, here in what is referred to as a working state, in other words for which the face screen is in working position and for which the flexible bib is in extended configuration.

FIG. 1 illustrates a protective helmet 1 provided to equip, in other words to be worn by, an electrician. In particular, this protective helmet 1 is configured to mechanically, electrically and thermally protect its wearer, and more specifically protect against the thermal dangers of electric arcs, when the wearer operates on electrical apparatuses and in particular on bare conductive parts connected to an electrical supply.

These operations are particularly dangerous since they take place for example on electrical cables connected to an electrical supply, whether they be aerial, underground or at ground level. There is the risk of electrocution and the risk of burns on account of possible electric arcs on disconnection and on reconnection of the electrical cables.

The wearer, in other words the electrician, thus needs to be protected mechanically, electrically and against the thermal dangers due to electric arcs. By that thermal protection is meant the fact of benefiting from a resistance to the energy released by electric arcs. This protection, whether it be mechanical, electrical and/or thermal, is specific and is even generally in accordance with a standard.

It is thus necessary for the electrician, wearer of the protective helmet 1, to be protected at the same time with regard to his head, the back of the neck, his face including in particular the eyes, and the part of the body from the chin to the top of the bust, including therefore the front and at least partially the sides of the neck.

The protective helmet 1 comprises an outside shell 2 formed from plastics material, which outside shell 2 is provided with a front zone 8, a rear zone 7 opposite the front zone 8, a first side 12 and a second side 13 opposite the first side 12.

This outside shell 2 delimits an internal space 10 of the helmet 1, which internal space 10 is provided to receive part of the wearer's head, in particular the part of the head situated between the forehead and the back of the neck.

The protective helmet 1 is furthermore provided with an inside shell 9 (FIG. 2) produced from plastics material and mechanically connected to the outside shell 2.

This inside shell 9 is thus formed in the internal space 10 of the helmet 1 and is disposed such that it defines, with the outside shell 2, an inter-shell space 11 formed between those two shells 2 and 9.

The protective helmet 1 is furthermore provided with a retaining strap 5 in two parts, respectively a relatively short first part 25 which is connected to the second side 13 of the outside shell 2 and a second part 26, longer than the first part 25, which is connected to the first side 12 of the outside shell 2.

Each of the first and second parts 25, 26 of the strap 5 is connected to the outside shell 2 via a fastener here formed by a screw fastener 6 comprising a nut and screw assembly, each of the two screw fasteners 6 being fastened to the outside shell 2 through a hole formed therein, respectively on its first side 12 and on its second side 13.

It will be noted that the strap here comprises rings, that is to say that the first and second respective parts 25, 26 of that strap 5 are each provided at their free end with a D-shaped tightening loop.

This retaining strap 5 is of course provided to retain the protective helmet 1 on its wearer, together with the outside and inside shells 2, 9 since these latter are on the top of the wearer's head whereas the retaining strap 5 is provided to be disposed under the wearer's chin.

The protective helmet 1 is furthermore provided with a face screen 3 and with a flexible bib 4 connected to that face screen 3.

The face screen 3 is here produced from plastics material tinted to protect the wearer from infrared radiation emitted on the occurrence of any electric arcs or flames. This face screen 3 thus has at least one coating layer configured to resist infrared radiation 29 and thus to protect the wearer of the helmet 1 from such infrared radiation.

This face screen 3 is of curved general shape substantially similar to the general shape of the front zone 8 of the outside shell 2, between the first side 12 and second side 13 of that outside shell 2.

The face screen 3 thus has a central zone delimited by an outside edge 14, an inside edge 15 which is an opposite edge to the outside edge 14 and by two lateral ends, respectively a first lateral end 27 and a second lateral end 28 which is an opposite end to the first lateral end 27.

The face screen furthermore has an outside face 16 as well as an inside face 18 which is an opposite face to the outside face 16.

The inside face 18 of the face screen 3 is the face configured to be directly opposite the face of the wearer of the helmet 1, as explained below.

It will be noted that the face screen 3 is furthermore provided, at the location of its first and second lateral ends 27 and 28, with a cut-out 17 for mounting the face screen 3 on the outside shell 2 and for guiding that screen 3 relative to that outside shell 2.

The face screen 3 is mounted in the inside internal space 10 of the helmet 1, and in particular at least partially in the inter-shell space 11 defined between the outside and inside shells 2 and 9.

The face screen 3 is connected to the outside shell 2 at the location of the first and second lateral ends 27 and 28 of that face screen 3, via screw fasteners 6 which are disposed respectively on the first and second sides 12 and 13 of that outside shell 2, as indicated above.

The face screen 3 is therefore connected to the outside shell 2 so as to be non-removable, in other words integrated with the helmet 1, but it is movably mounted relative to that outside shell 2.

Figure 2:
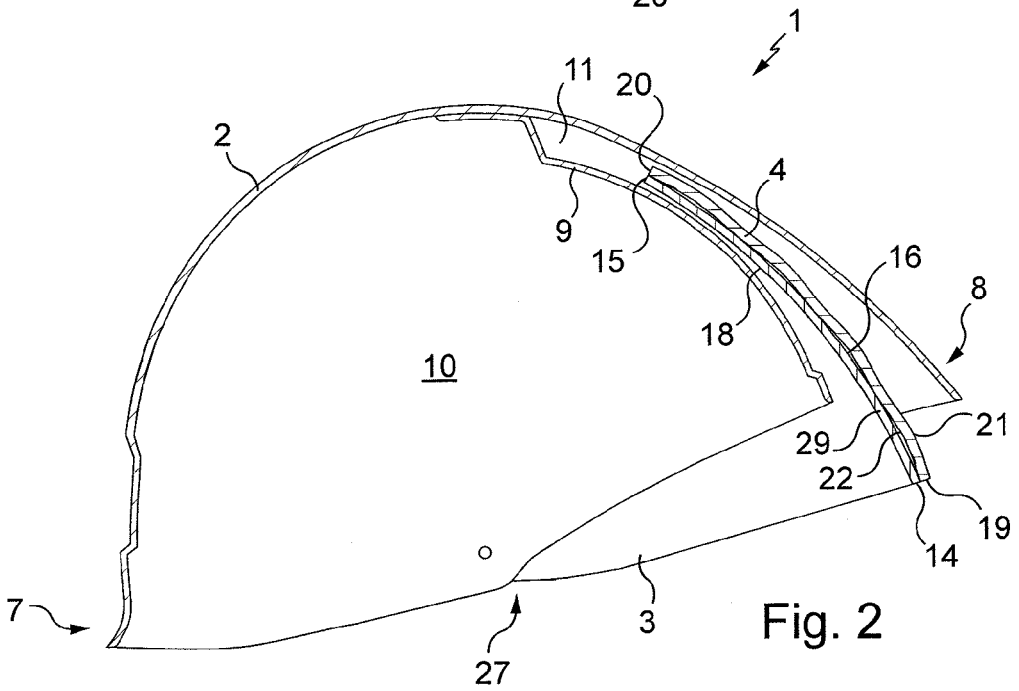
FIG. 2 is a cross-section view on a median plane of the helmet illustrated in FIG. 1, here in what is referred to as a resting state, in other words with the face screen in withdrawn position and the flexible bib in retracted configuration.

The face screen 3 is thus hinged relative to the outside shell 2, at the location of its first and second lateral ends 27 and 28 and has two positions, i.e. a withdrawn position corresponding to the resting state of the helmet 1, illustrated in FIG. 2, and a working position corresponding to the working state of that helmet 1, illustrated in FIG. 1; as stated below in more detail.

It will be noted that, both in the withdrawn position and in the working position of the face screen 3, its inside free edge 15 is in the neighborhood of the outside shell 2, inside the inter-shell space 11; whereas its outside free edge 14 is in the neighborhood of the outside shell 2 only in the withdrawn position of that face screen 3 (in the internal space 10 of the helmet 1), and is away from that outside shell 2 in the working position of the face screen 3.

As regards the flexible bib 4, this is produced from a textile material, here a cotton treated and configured to resist fire. The flexible bib 4 is provided to protect the part of the wearer located essentially between his chin and the top of the bust. The flexible bib 4 thus has a particular shape and dimensions making it possible to protect that part of the wearer's body from the thermal hazards caused by electric arcs, and the flexible bib 4 thus furthermore makes it possible to protect that part of the wearer's body against flames and projections of molten metal.

The flexible bib 4 is connected by a connection portion 23 to the face screen 3 while being fastened thanks to rivets 24 along a major part of the outside free edge 14 of that face screen 3.

The flexible bib 4 is thus non-removable, in other words it is integrated with the helmet 1 via the face screen 3, but is movable relative to that face screen 3.

To be precise, the flexible bib 4 has a first edge 19 and a second edge 20 that is an opposite edge to the first edge 19, which second edge 20 is also referred to as a free edge; such that it is by its first edge 19 and in particular by the connection portion 23 provided in the neighborhood of that first edge 19 that the flexible bib 4 is riveted to the face screen 3 at the location of the outside edge 14 thereof.

Here, a plurality of rivets 24 enables this connection of the flexible bib to the face screen 3.

It will be noted that the flexible bib furthermore has an inside face 21 as well as an outside face 22 which is an opposite face to that inside face 21; which inside face 21 is configured to be located directly opposite, or even in contact with, the part of the wearer's body situated between his chin and the top of the bust.

The flexible bib 4 is of complementary general shape to that of the face screen 3, that shape being mainly due to its fastening to that face screen 3 and to its curved general shape which it has in the neighborhood of its second edge 20.

The configuration of the flexible bib 4 relative to the face screen 3 and the material of that flexible bib 4 enable the latter to have different configurations, i.e. a retracted first configuration corresponding to the resting state of the helmet 1, illustrated in FIG. 2; as well as a working second configuration corresponding to the working state of the helmet 1, illustrated in FIG. 1; as explained below in more detail.

It will be noted that by its connection to the face screen 3, the flexible bib 4 is thus disposed so as to be non-removable relative to the latter and more generally relative to the outside shell 2; which flexible bib 4 is thus described as being integrated with the protective helmet 1, like the face screen 3.

There will now be described in more detail the arrangement of the outside shell 2, of the face screen 3 and of the flexible bib 4, relative to each other and relative to the wearer 30, in the resting and working states of the helmet 1, as well as in the intermediate state corresponding to the passage from one to the other of these states, with reference to FIGS. 3 to 5.

The wearer 30, in other words the electrician, possesses a head 31, a neck 32, and a bust 33.

The front 34 of the head 31 of the wearer 30 will be defined as representing the face, which front 34 of the head 31 is opposite to the back 36 of that head 31, which head 31 furthermore has a top (not shown). The back 37 of the neck 32 and the front 38 opposite to the back 37 are also defined. Furthermore, only the top 39 of the bust 33 is represented here.

Figure 3:
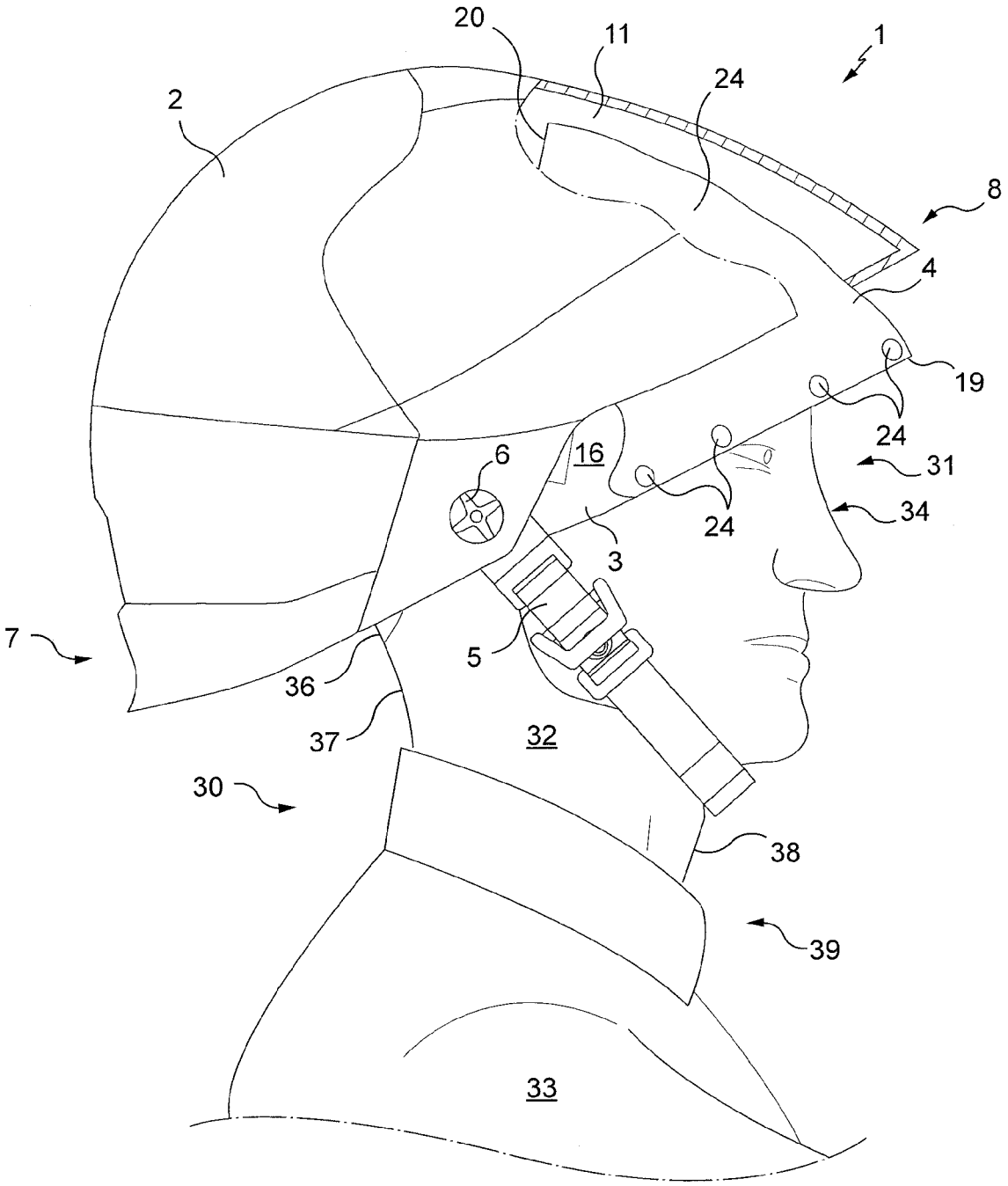
FIG. 3 is an side view of the helmet illustrated in FIG. 1, in the resting state and of which the outside shell is partially torn away.

FIG. 3 illustrates the protective helmet 1 in its resting state. In this state, the face screen 3 is in its withdrawn position and the flexible bib 4 is in its retracted configuration.

Here, the outside shell 2 protects the top and back 36 of the wearer's head 31 essentially mechanically and electrically. In other words, the face 34, the front 38 of the neck 32 as well as the top 39 of the bust 33 is not protected in that resting state of the helmet 1, when the electrician is not normally operating on an electrical apparatus connected to an electrical supply.

In the withdrawn position of the face screen 3, the latter is inserted almost fully into the inter-shell space 11, with its inside free edge 15 being located in that inter-shell space 11 and its outside free edge 14 being located in the neighborhood of that inter-shell space 11.

In the retracted configuration of the flexible bib 4, the latter is folded around its connection portion 23, such that its outside face 22 at least partially covers the outside face 16 of the face screen 3.

The shape of the flexible bib 4, which is curved here in the neighborhood of its second edge 20, and the fire-resistant fabric from which that flexible bib 4 is produced enable the latter to conform to the curved shape of the outside face 16 of the face screen 3.

In this retracted configuration, it is thus the inside face 21 of the flexible bib 4 which is located facing an inside face (not shown) of the outside shell 2.

It will also be noted that since the flexible bib 4 is turned over the face screen 3, the latter is therefore at least partially inserted into the inter-shell space 11.

Figure 4:
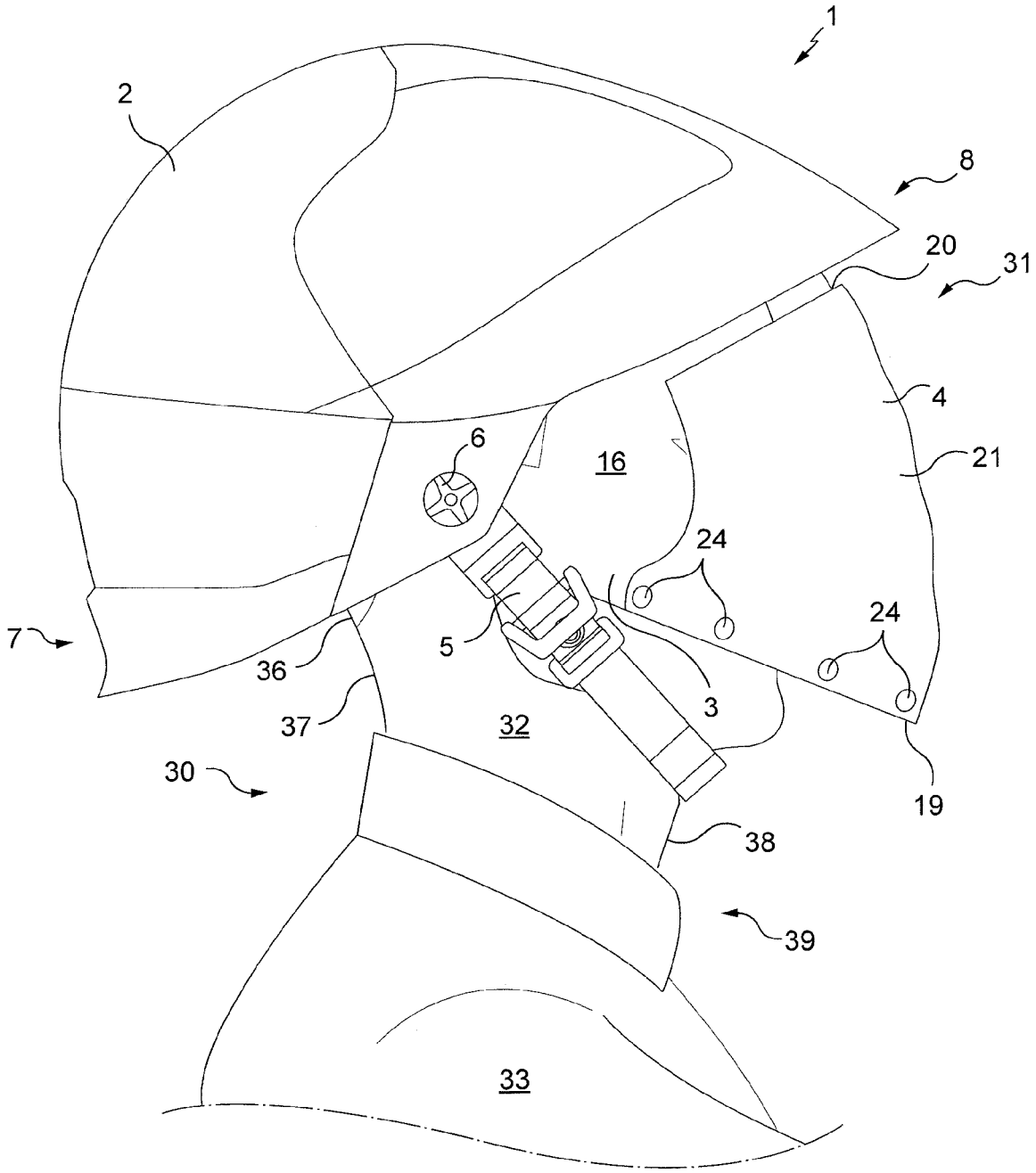
FIG. 4 is an side view of the helmet illustrated in FIG. 1, in an intermediate state showing the passage from the resting state to the working state.
Figure 5:
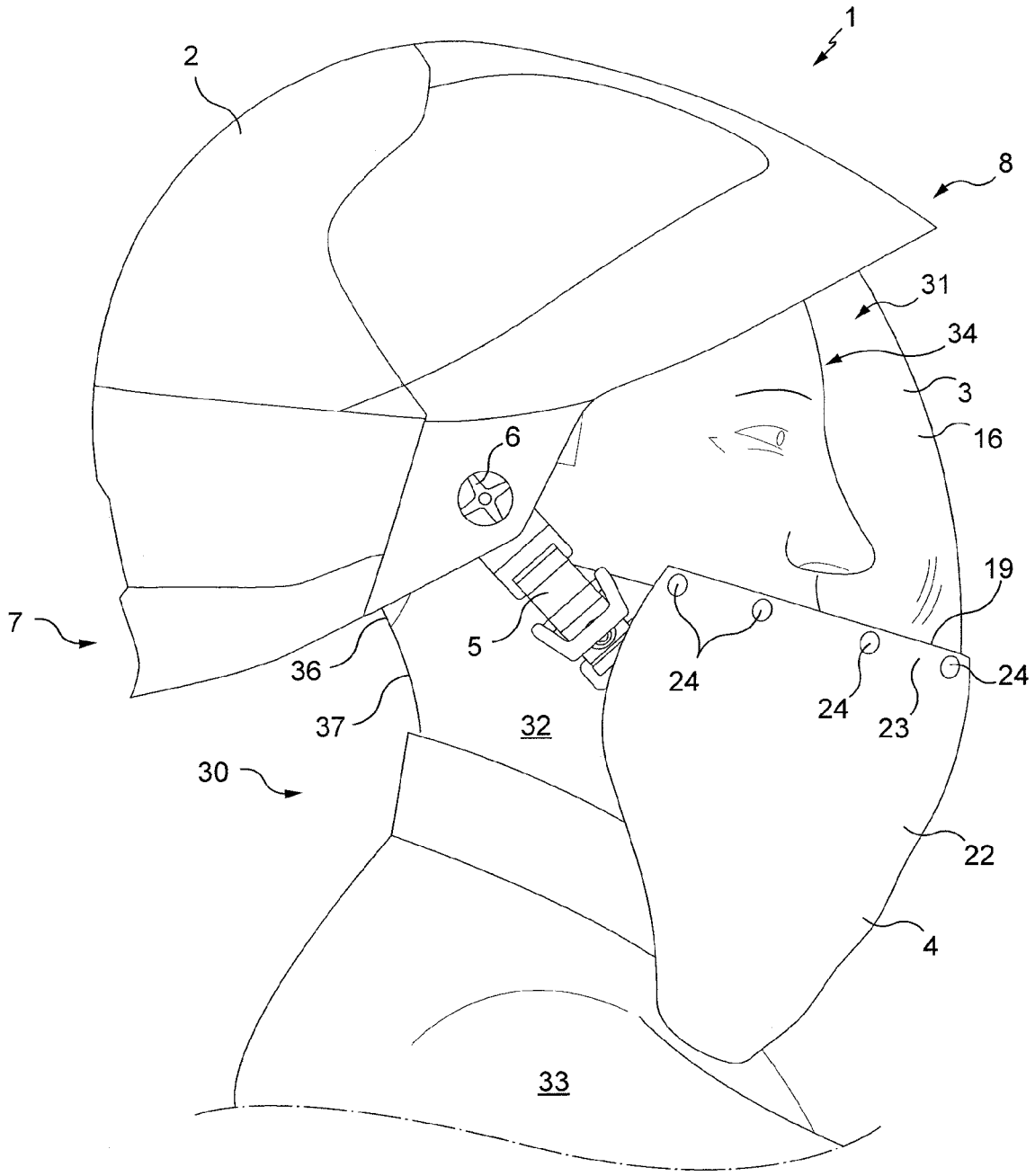
FIG. 5 is a similar view to FIG. 4, the helmet being in the working state as illustrated in FIG. 1.

FIG. 4 illustrates an intermediate state of the protective helmet 1 showing the passage from its resting state (FIG. 3) to its working state (FIG. 5).

In this intermediate state of the protective helmet 1, the face screen 3 is in the working position whereas the flexible bib 4 is still in the retracted configuration.

To pass from the withdrawn position to the working position, the face screen 3 is hinged relative to the outside shell 2, so as to make the face screen 3 come out almost entirely, but not fully, from the inter-shell space 11.

In this working position, the inside free edge 15 of the face screen 3 is still in the neighborhood of the inter-shell space 11, or even still inside the latter, whereas the outside free edge 14 of that face screen 3 is away from the inter-shell space 11 and even from the internal space 10 of the helmet 1.

In this working position, the face screen 3 is located directly opposite the face 34 of the wearer 30, which face 34 extends substantially from the top of the forehead to the chin.

Of course, in this intermediate state of the protective helmet 1, no action is possible by the wearer 30 of the helmet 1, since his vision is obstructed by the flexible bib 4 which still covers the outside face 16 of that face screen 3.

FIG. 5 illustrates the protective helmet 1 in its working state as in FIG. 1.

In this working state, the outside shell 2 as well as the face screen 3 are positioned in the same way as in the intermediate state, but here, the flexible bib 4 is now in the working configuration rather than being in the withdrawn configuration.

This means that the flexible bib 4 is extended, in other words that it is unfolded about its connection portion 23, and that it thus extends the face screen 3.

It will be noted that the flexible bib 4 then uncovers the outside face 16 of the face screen 3 and it is now the outside face 22 of that flexible bib 4 that is directed towards the outside (in other words which is visible by an observer looking at the wearer having the protective helmet in its working state).

It will be noted that the flexible bib 4 is of substantially similar general shape to that of the face screen 3, apart from the fact that this bib 4 is not rigid but flexible and thus can be of a shape that is only approximately curved, both in the direction defined between its first edge 19 and its second edge 20, and in the direction defined between the first and second sides 12 and 13 of the outside shell 2 passing via that flexible bib 4.

In this working configuration of the flexible bib 4, the latter is thus disposed opposite the part of the wearer's body 30 located between the chin, in other words the bottom of the his face 34, and the top 39 of the bust 33, including the front 38 and at least partially the sides of the neck 32.

This flexible bib 4 is particularly easy to manipulate by the wearer 30 of the protective helmet 1.

The flexible bib 4 thus enables the wearer to be protected against thermal hazards due to elastic arcs, flames and projections of molten metal, beyond the face screen 3 without however hindering the wearer's movements, on account of the flexibility of that bib 4.

The protective helmet 1 described above thus provides particularly complete protection of the zones of the wearer's head and upper bust that may be subjected to mechanical, electrical and/or thermal stresses and/or hazards when operating on electrical apparatuses, while being particularly simple and convenient to use, in other words to pass from one to the other of the configurations of that flexible bib 4, and from one to the other of the positions of that face screen 3; while being particularly safe since this is a protective helmet 1 of which the protective components, i.e. the outside shell 2, the inside shell 9, the face screen 3 and the flexible bib 4 are integrated with the protective helmet 1.

It will be noted that to bring the protective helmet 1 to its resting state, starting from its working state, the flexible bib 4 is first of all folded about its connection portion 23 to at least partially cover the outside face of the face screen 3 and that the face screen 3 is next hinged so as to be almost fully re-inserted, together with the flexible bib 4, into the inter-shell space 11.

These are thus the reverse steps to those described above with reference to FIGS. 3 to 5.

In variants that are not illustrated:

- the protective helmet lacks any inside shell and does not have any inter-shell space and the assembly formed by the face screen and the flexible bib, respectively in withdrawn position and in retracted configuration, is directly inserted into the internal space of the helmet.
- the protective helmet lacks outside and inside shells, but instead comprises a first shell similar to the outside shell which can be seen in the Figures as well as a second shell connected to the first shell and extending superposed with respect to the latter; the first shell thus forms a half-outside shell and a half-inside shell, whereas the second shell forms another half-outside shell;
- the face screen lacks an anti-infrared coating and the face screen has no tinting or has other types of tinting.
- the flexible bib is produced from treated artificial fibers rather than from natural fibers, such as cotton;
- the connection of the flexible bib to the face screen is not made using rivets, instead being adhesive for example self-adhesive or adhesive using hooks, for example of Velcro® type, or else a configured system such as a zip closure, or more generally with mechanical means other than rivets, for example screws;
- the devices for connecting the face screen to the outside shell are different from screw fasteners, being instead shanks with circlips, or else screws alone, or else quarter-turn bayonet type systems; and/or
- the protective helmet lacks a retaining strap or has a retaining strap of a type different than with D-shaped loops, and, for example, is a mechanical system having locking anchorage such as that used for example to buckle safety belts in vehicles.

It should be noted more generally that the invention is not limited to the examples described and represented.

The invention claimed is:

1. A protective helmet provided to be worn by an electrician, comprising an outside shell (2), a face screen (3) integrated with said helmet (1), which face screen (3) is connected to said outside shell (2) so as to be non-removable and is movable relative to said outside shell (2), which face screen (3) furthermore has a withdrawn position in which said face screen (3) is inserted at least partially inside an internal space (10, 11) of said helmet (1), which internal space (10, 11) is delimited by said outside shell (2), and a working position in which said face screen (3) projects from said internal space (10, 11); wherein the protective helmet further comprises a flexible bib (4) integrated with said helmet (1), which flexible bib (4) is connected to said face screen (3) so as to be non-removable and is movable relative to said face screen (3), which flexible bib (4) further has a retracted configuration in which said flexible bib (4) at least partially covers a face (16) of said face screen (3) as well as a working configuration in which said flexible bib (4) is extended and extends said face screen (3).

2. A helmet according to claim 1, wherein said flexible bib (4) is produced from a textile material configured to resist fire.

3. A helmet according to claim 1, wherein said flexible bib (4) is configured to conform to said face (16) of said face screen (3) that said flexible bib (4) covers in its retracted configuration.

4. A helmet according to claim 1, wherein said face screen (3) has an inside free edge (15) and an outside free edge (14) which is an opposite edge to said inside free edge (15), which inside free edge (15) is in the neighborhood of said outside shell (2) both in the withdrawn and working positions of said face screen (3), whereas said outside free edge (14) is in the neighborhood of said outside shell (2) in said withdrawn position of said face screen (3) and is away from said outside shell (2) in said working position of said face screen (3); and said flexible bib (4) is fastened on said outside free edge (14) of said face screen (3).

5. A helmet according to claim 4, wherein said flexible bib (4) is fastened along a major part of said outside free edge (14) of said face screen (3) by rivets (24).

6. A helmet according to claim 1, wherein said face screen (3) has at least one coating layer configured to resist infrared radiation (29).

7. A helmet according to claim 1, wherein said face screen (3) furthermore has a first lateral end (27) and a second lateral end (28) which is an opposite end to said first lateral end (27), and is hinged relative to said outside shell (2) at the location of each of said first and second lateral ends (27, 28).

8. A helmet according to claim 1, further comprising an inside shell (9) disposed in said internal space (10) and fastened to said outside shell (2), which outside (2) and inside (9) shells define between them an inter-shell space (11) in which said face screen (3) and said flexible bib (4) are at least partly inserted when these latter are respectively in withdrawn position and retracted configuration.

9. A helmet according to claim 8, wherein said outside shell (2) and said inside shell (9) are each produced from plastics material molded in a single piece and said inside shell (9) is mechanically connected to said outside shell (2).

10. A helmet according to claim 1, further comprising a retaining strap (5) in two parts (25, 26), each of said two parts (25, 26) being connected to said outside shell (2).

11. The helmet according to claim 2, wherein said flexible bib (4) is configured to conform to said face (16) of said face screen (3) that said flexible bib (4) covers in its retracted configuration.

12. The helmet according to claim 2, wherein said face screen (3) has an inside free edge (15) and an outside free edge (14) which is an opposite edge to said inside free edge (15), which inside free edge (15) is in the neighborhood of said outside shell (2) both in the withdrawn and working positions of said face screen (3), whereas said outside free edge (14) is in the neighborhood of said outside shell (2) in said withdrawn position of said face screen (3) and is away from said outside shell (2) in said working position of said face screen (3); and said flexible bib (4) is fastened on said outside free edge (14) of said face screen (3).

13. The helmet according to claim 3, wherein said face screen (3) has an inside free edge (15) and an outside free edge (14) which is an opposite edge to said inside free edge (15), which inside free edge (15) is in the neighborhood of said outside shell (2) both in the withdrawn and working positions of said face screen (3), whereas said outside free edge (14) is in the neighborhood of said outside shell (2) in said withdrawn position of said face screen (3) and is away from said outside shell (2) in said working position of said face screen (3); and said flexible bib (4) is fastened on said outside free edge (14) of said face screen (3).

14. The helmet according to claim 2, wherein said face screen (3) has at least one coating layer configured to resist infrared radiation (29).

15. The helmet according to claim 3, wherein said face screen (3) has at least one coating layer configured to resist infrared radiation (29).

16. The helmet according to claim 4, wherein said face screen (3) has at least one coating layer configured to resist infrared radiation (29).

17. The helmet according to claim 5, wherein said face screen (3) has at least one coating layer configured to resist infrared radiation (29).

18. The helmet according to claim 2, wherein said face screen (3) furthermore has a first lateral end (27) and a second lateral end (28) which is an opposite end to said first lateral end (27), and is hinged relative to said outside shell (2) at the location of each of said first and second lateral ends (27, 28).

19. The helmet according to claim 3, wherein said face screen (3) furthermore has a first lateral end (27) and a second lateral end (28) which is an opposite end to said first lateral end (27), and is hinged relative to said outside shell (2) at the location of each of said first and second lateral ends (27, 28).

20. The helmet according to claim 4, wherein said face screen (3) furthermore has a first lateral end (27) and a second lateral end (28) which is an opposite end to said first lateral end (27), and is hinged relative to said outside shell (2) at the location of each of said first and second lateral ends (27, 28).

* * * * *